US009662698B2

(12) United States Patent
Chuang

(10) Patent No.: US 9,662,698 B2
(45) Date of Patent: May 30, 2017

(54) TUBE BENDER

(71) Applicant: Chieh-Yu Cheng, Taichung (TW)

(72) Inventor: Shu-Mei Chuang, Taichung (TW)

(73) Assignee: Chieh-Yu Cheng, Taichung (TW)

( * ) Notice: Subject to any disclaimer, the term of this patent is extended or adjusted under 35 U.S.C. 154(b) by 27 days.

(21) Appl. No.: 14/789,587

(22) Filed: Jul. 1, 2015

(65) Prior Publication Data

US 2016/0089707 A1 Mar. 31, 2016

(30) Foreign Application Priority Data

Sep. 26, 2014 (TW) ..... 103217175 U

(51) Int. Cl.
*B21D 7/06* (2006.01)
*B21D 7/024* (2006.01)

(52) U.S. Cl.
CPC ..... *B21D 7/063* (2013.01); *B21D 7/024* (2013.01)

(58) Field of Classification Search
CPC ..... B21D 7/024; B21D 7/025; B21D 7/04; B21D 7/063
See application file for complete search history.

(56) References Cited

U.S. PATENT DOCUMENTS 3,236,082 A * 2/1966 Beck ..... B21D 7/022 228/17.5
3,336,779 A * 8/1967 Schall ..... B21D 7/063 72/217

FOREIGN PATENT DOCUMENTS

| | | |
|---|---|---|
| TW | 161436 | 6/1991 |
| TW | M283695 | 12/2005 |
| TW | I356740 | 1/2012 |
| TW | I409112 | 9/2013 |
| TW | I425989 | 2/2014 |

* cited by examiner

*Primary Examiner* — Debra Sullivan
(74) *Attorney, Agent, or Firm* — Muncy, Geissler, Olds & Lowe, P.C.

(57) ABSTRACT

A tube bender is provided. A rotatable member is pivoted to a base, defines an inner space and has a rack portion extending around the pivot portion within the inner space, a first arched groove archedly extending around the pivot portion and a holding portion having a holding recess for a tube. An abutting assembly has an arm portion connected with the base and an abutting chunk assembled to the arm portion. A gear assembly includes a driving assembly for being driven by a driving tool and a rotating assembly which is pivoted to the base and rotatably connected with the driving assembly. The driving assembly is pivoted to the arm portion and non-coaxially arranged with the rotating assembly, and the rotating assembly has a first toothed portion meshed with the rack portion and a driven portion meshed with the driving assembly.

14 Claims, 7 Drawing Sheets

TUBE BENDER

BACKGROUND OF THE INVENTION

Field of the Invention

The present invention relates to a bender, and more particularly to a tube bender.

Description of the Prior Art

Usually, when arranging pipelines, non-straight tube members are needed in various environments; therefore, it is necessary to use a bender to bend a straight tube member. Such tube benders are disclosed in TWI356740, TWI425989 and TWI409112. However, this type of tube benders are usually used to produce bended tubes in the same dimension in a large number, and this type of tube benders are too large to be carried around and have complex structures.

Another type of tube benders as disclosed in TW161436 and TWM283695 are convenient to be carried around and can be driven by human power. However, this type of tube bender is energy-consuming and time-consuming.

The present invention has arisen to mitigate and/or obviate the afore-described disadvantages.

SUMMARY OF THE INVENTION

The major object of the present invention is to provide a tube bender which allows a user to bend a tube with less energy. In addition, the tube bender has a simple structure for the user to carry around and use, and the tube bender can be assembled and disassembled in accordance with various requirements. When a member is damaged, the user only needs to replace the damaged member; therefore, it is convenient and economical for the user to use the tube bender.

To achieve the above and other objects, a tube bender is provided, including a base, a rotatable member, an abutting assembly and a gear assembly. The base has a pivot portion. The rotatable member is pivoted to the pivot portion and defines an inner space, and the rotatable member has a rack portion, a first arched groove and a holding portion. The rack portion archedly extends around the pivot portion and is located within the inner space, the first arched groove archedly extends around the pivot portion on an outer circumferential surface of the rotatable member, and the holding portion has a holding recess for a tube member to abut thereagainst. The abutting assembly has an arm portion connected with the base and an abutting chunk assembled to the arm portion. The gear assembly includes a driving assembly for being driven by a driving tool and a rotating assembly which is pivoted to the base and rotatably connected with the driving assembly. The driving assembly is pivoted to the arm portion and non-coaxially arranged with the rotating assembly, and the rotating assembly has a first toothed portion meshed with the rack portion and a driven portion meshed with the driving assembly.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
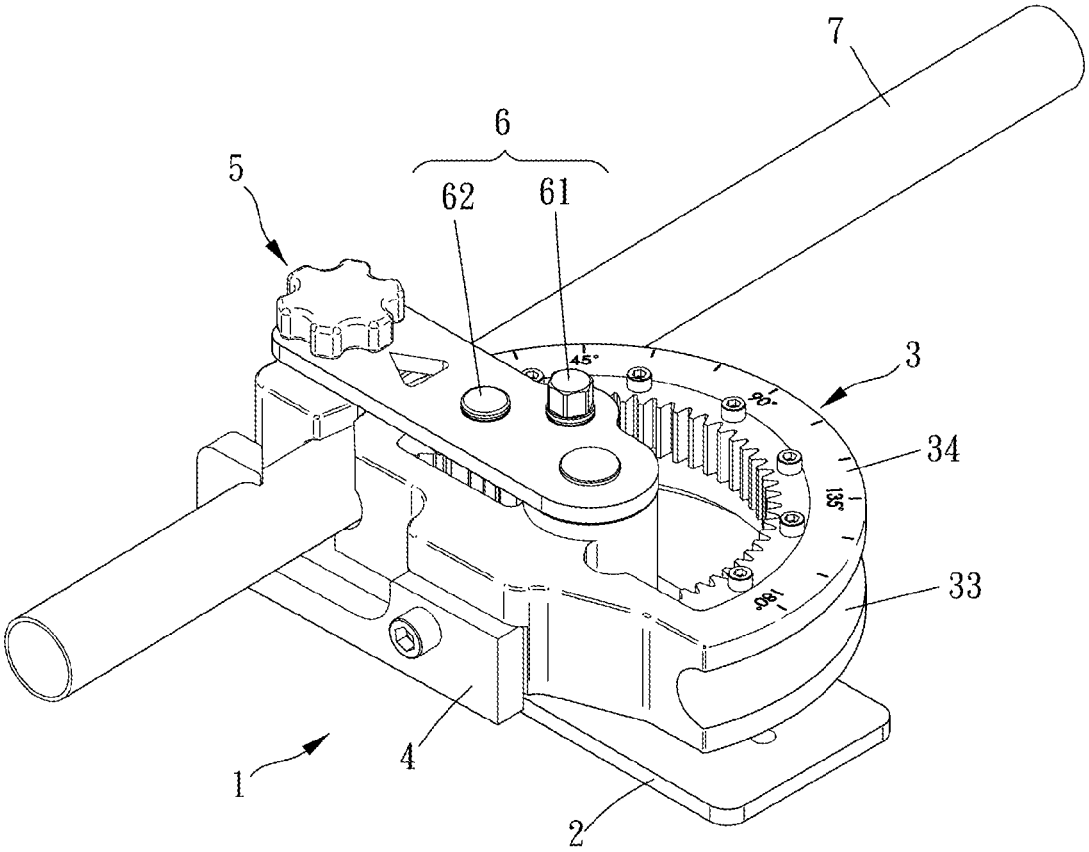
FIG. 1 is a drawing showing a preferred embodiment of the present invention.
Figure 2:
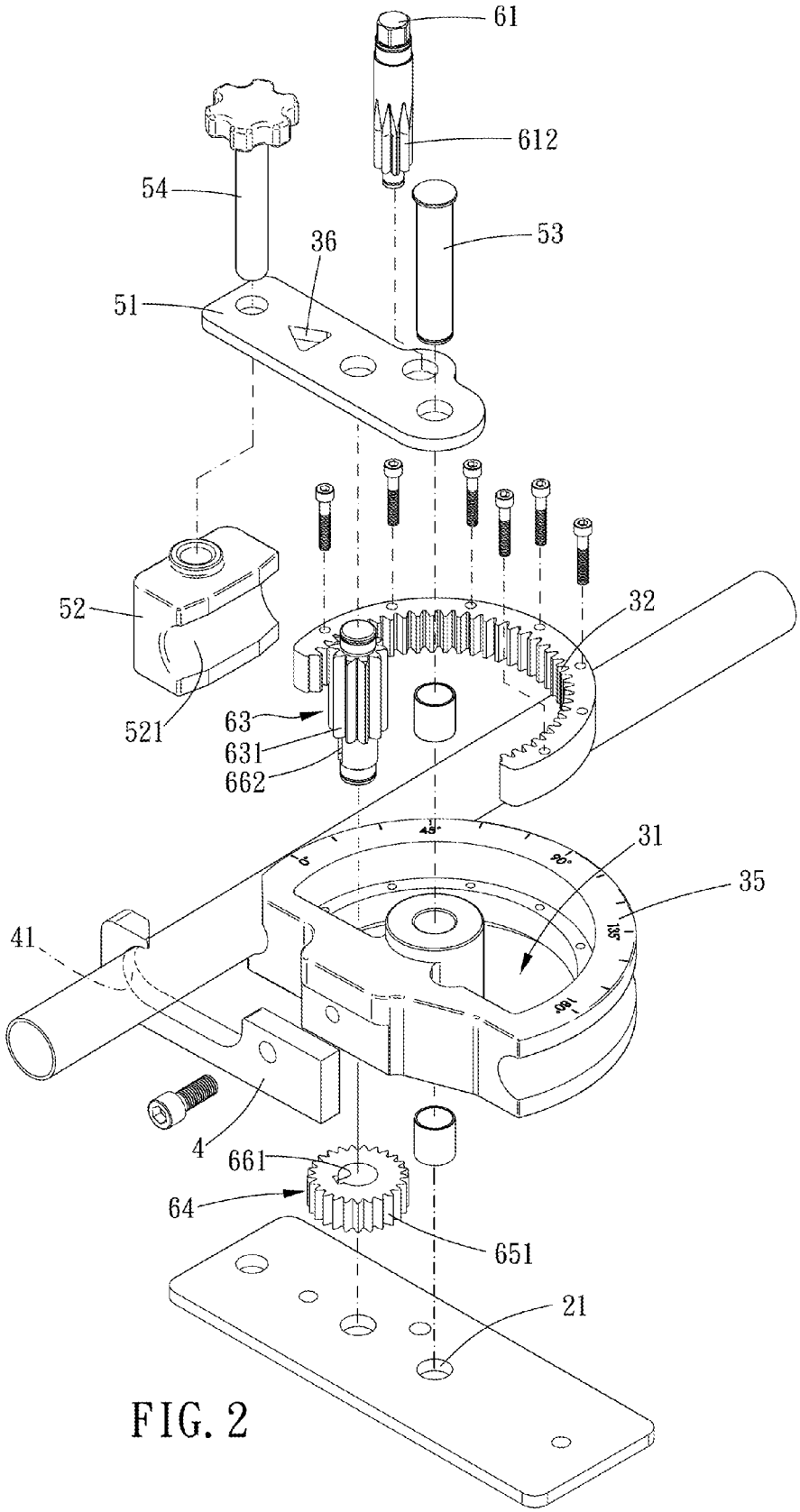
FIG. 2 is a drawing showing assembling of the preferred embodiment of the present invention.
Figure 3:
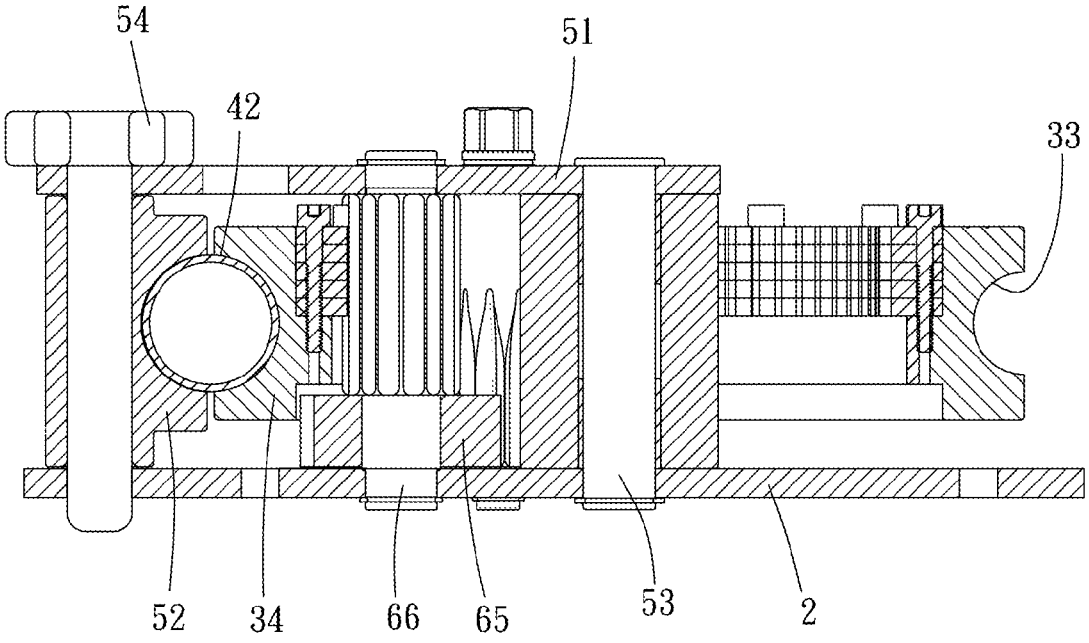
FIG. 3 is a side cross-sectional drawing of the preferred embodiment of the present invention.

The present invention will be clearer from the following description when viewed together with the accompanying drawings, which show, for purpose of illustrations only, the preferred embodiment in accordance with the present invention.

Please refer to FIGS. 1 to 6 for a preferred embodiment of the present invention. A tube bender 1 includes a base 2, a rotatable member 3, an abutting assembly 5 and a gear assembly 6.

The base 2 has a pivot portion 21. The rotatable member 3 is pivoted to the pivot portion 21 and defines an inner space 31, and the rotatable member 3 has a rack portion 32, a first arched groove 33 and a holding portion 4. The rack portion 32 archedly extends around the pivot portion 21 and located within the inner space 31. The first arched groove 33 archedly extends around the pivot portion 21 on an outer circumferential surface of the rotatable member 3. The holding portion 4 has a holding recess 41 for a tube member 7 to abut thereagainst. The abutting assembly 5 has an arm portion 51 connected with the base 2 and an abutting chunk 52 assembled to the arm portion 51. The gear assembly 6 includes a driving assembly 61 for being driven by a driving tool and a rotating assembly 62 which is pivoted to the base 2 and rotatably connected with the driving assembly 61. The driving assembly 61 is pivoted to the arm portion 51 and non-coaxially arranged with the rotating assembly 62. The rotating assembly 62 has a first toothed portion 631 which is meshed with the rack portion 32 and a driven portion 64 which is meshed with the driving assembly 61.

Specifically, the first toothed portion 631 is arranged on an outer circumferential surface of a first gear 63, and the driven portion 64 is a second gear 65 having a second toothed portion 651. Wherein, an outer circumferential surface of the driving assembly 61 has a fourth toothed portion 612 which is meshed with the second toothed portion 651, and a diametral pitch of the second gear 65 is greater than a diametral pitch of the fourth toothed portion 612 of the driving assembly 61. When a driving tool (for example, a ratchet wrench or a pneumatic tool) is used to drive the driving assembly 61 to rotate, the fourth toothed portion 612 is rotated to drive the second gear 65. Because the diametral pitch of the second gear 65 is relatively greater, a greater torsion is produced to drive the rotatable member 3 having the rack portion 32 and make the rotatable member 3 rotate about the pivot portion 21. That is, the second gear 65 can magnify the output torsion, so it is more energy-saving to bend the tube member 7. Relatively less energy is needed to drive the rotatable member 3 to cooperate with the abutting assembly 5 to bend the tube member 7 into any angle.

In this embodiment, the first and second gears 63, 65 are coaxially arranged and comovably connected with each other, so the first gear 63 has the same torsion as the second gear 65 does to drive the rotatable member 3. Specifically, the first gear 63 and the second gear 65 are disposed through by a first pivot axle 66 and pivoted to the base 2, wherein the first pivot axle 66 and the first gear 63 are integrally formed;

however, the first pivot axle 66 and the second gear 65 may be integrally formed, or the first pivot axle 66 may be connected with the first and second gears 63, 65 respectively. To make the first and second gears 63, 65 coaxially rotate, one of the second gear 65 and the first pivot axle 66 has a recess portion 661, and the other of the second gear 65 and the first pivot axle 66 has a protrusive portion 662 which is engageable with the recess portion 661. In this embodiment, the second gear 65 has the recess portion 661, and the first pivot axle 66 has one said protrusive portion 662 which is engageable with the recess portion 661; therefore, when the second gear 65 rotates, the protrusive portion 662 allows the first gear 63 to rotate coaxially with the second gear 65. However, ways of connection of the first and second gears are not limited thereto.

Figure 7:
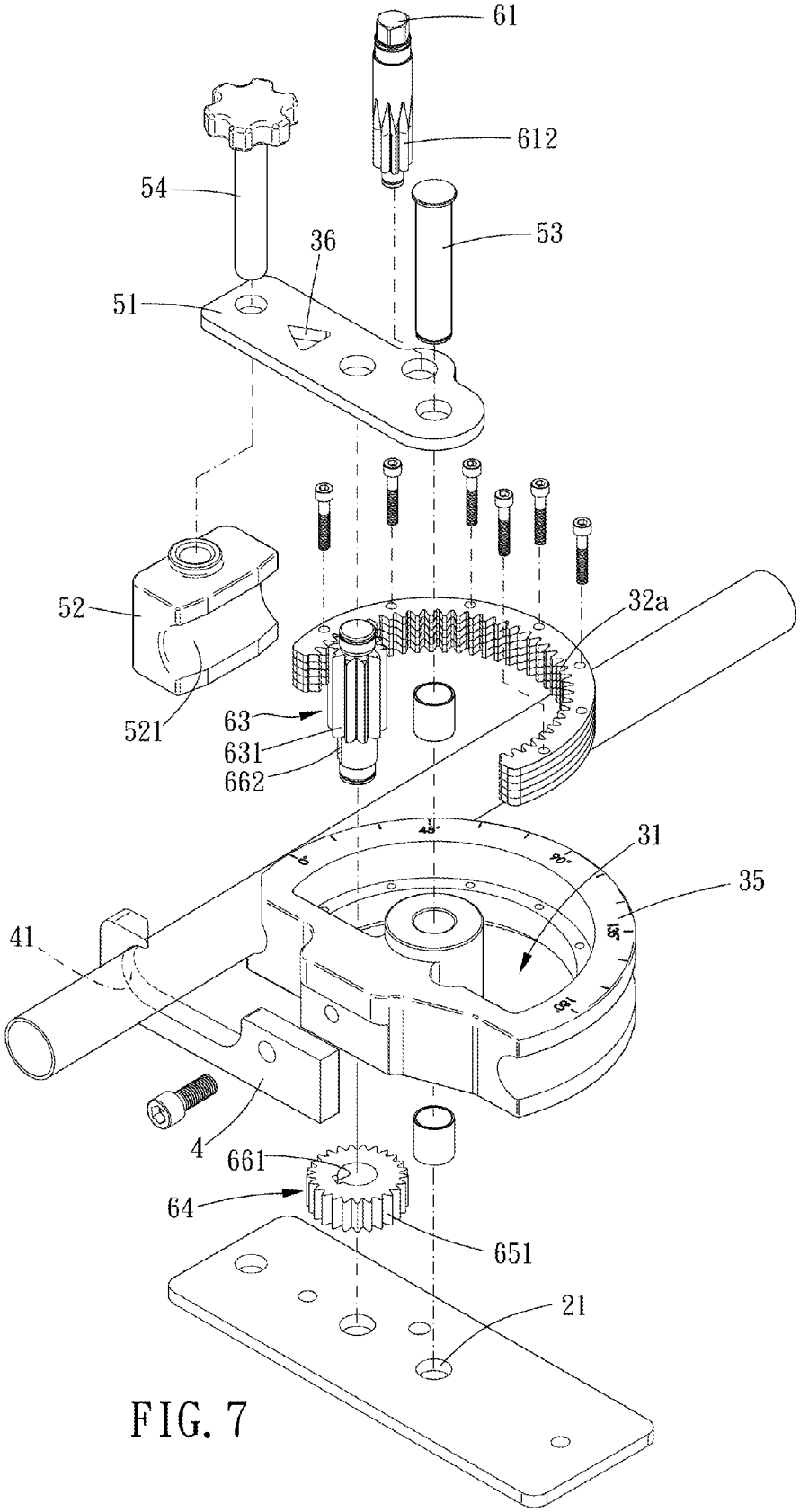
FIG. 7 is a drawing showing another preferred embodiment of the preferred embodiment of the present invention.

Preferably, the rotatable member 3 further includes a main body 34, and the main body 34 defines the inner space 31. The rack portion 32 is detachably assembled with the main body 34. When the rack portion 32 is damaged, the rack portion 32 can be replaced easily and quickly, and a number and a dimension of a tooth of the rack portion 32 may vary in accordance with various requirements. Furthermore, the main body 34 protects the rack portion 32 from unexpected impacts. In this embodiment, the rack portion 32 is integrally formed and detachably assembled with the main body 34, and the holding portion 4 is detachably assembled with the main body 34 through screwing; therefore, the mode of the holding portion 4 may vary in accordance with different requirements. Furthermore, please further refer to FIG. 7 for a rack portion 32*a* of another preferred embodiment. The rack portion 32*a* may be assembly type, so a thickness of the rack portion 32*a* can be adjusted in accordance with various requirements. In addition, when a part of the toothed portion is damaged, only a part of the rack portion 32*a* is needed to be replaced.

Preferably, when the holding portion 4 is assembled with the main body 34, as viewed in a radial direction of the rotatable member 3, a radial edge of the holding recess 41 is located outwardly beyond a radial edge of the first arched groove 33 so that the holding recess 41 and the first arched groove 33 form a holding aperture 42, and the holding aperture 42 tightly abuts against an outer circumferential surface of the tube member 7. Therefore, the tube member 7 is stably bent to form during the bending process.

The arm portion 51 is connected with the base 2 through a second pivot axle 53 which is disposed through the rotatable member 3 and pivoted to the pivot portion 21, and the abutting chunk 52 of the abutting assembly 5 is detachably assembled to the arm portion 51 through a pin 54; therefore, the abutting chunk 52 can be fixed to any steady object(s) through the pin 54 to provide a stable abutting face for the tube member 7 to abut thereagainst and be bent. During the bending process, an angle of the abutting chunk 52 relative to the first arched groove 33 may be adjusted in accordance with a bending angle of the tube member 7 to decrease a resistance produced during the bending process to prevent the tube member 7 or the tube bender 1 from being damaged. Preferably, the abutting chunk 52 has a second arched groove 521 opposite to the first arched groove 33. The second arched groove 521 and the first arched groove 33 arch oppositely, so it is convenient to arrange the tube member 7 between the abutting chunk 52 and the first arched groove 33. More importantly, the second arched groove 521 which arches oppositely to the first arched groove 33 provides a surface to concentrate force on the tube member 7 to make the tube member 7 to be bent more easily. More conveniently, the abutting chunk 52 is detachably positioned between the arm portion 51 and the base 2; therefore, as soon as the abutting chunk 52 is positioned on the base 2, the tube bender 1 can be used immediately.

Figure 4:
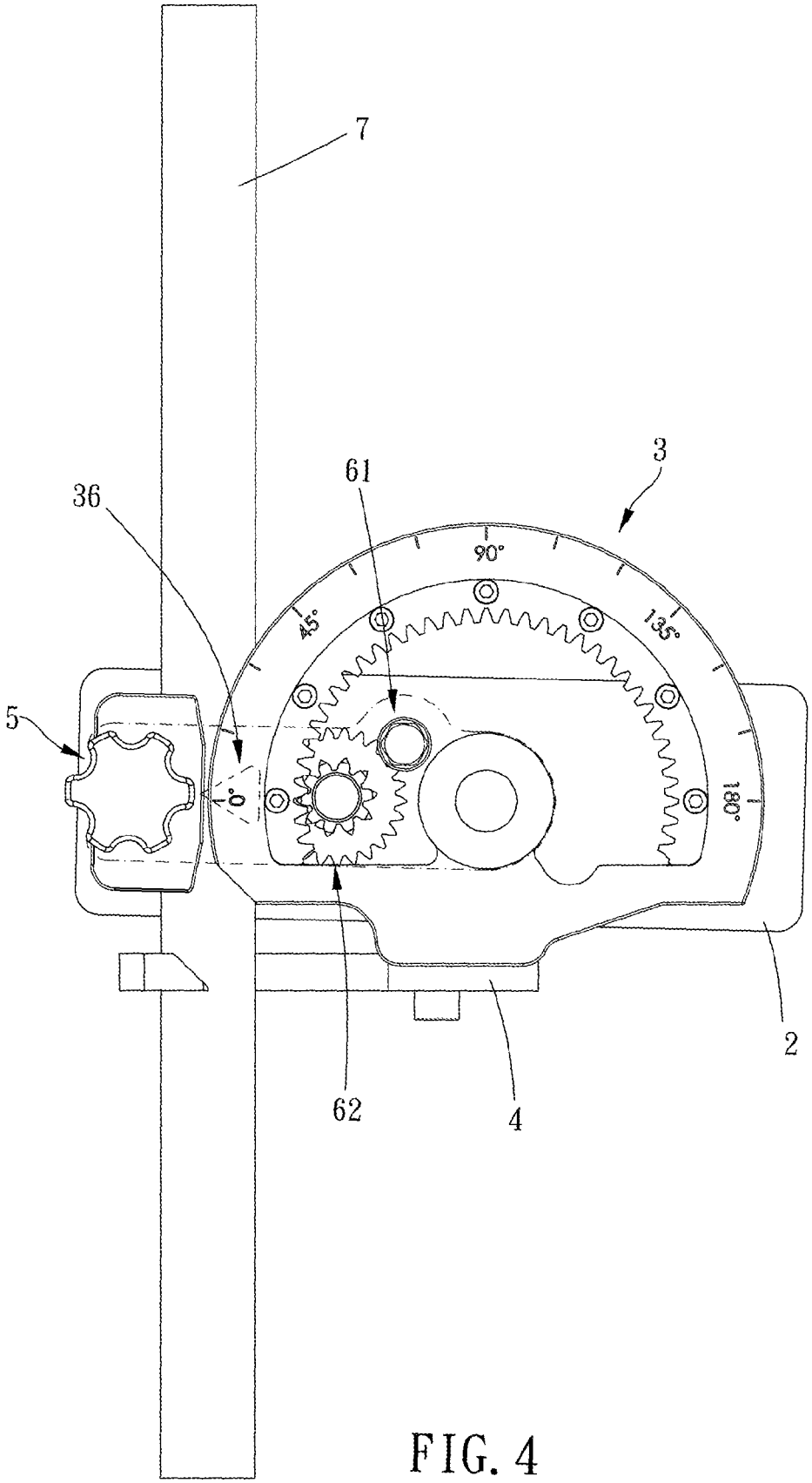
FIGS. 4 to 6 are drawings showing operation of the preferred embodiment of the present invention.
Figure 5:
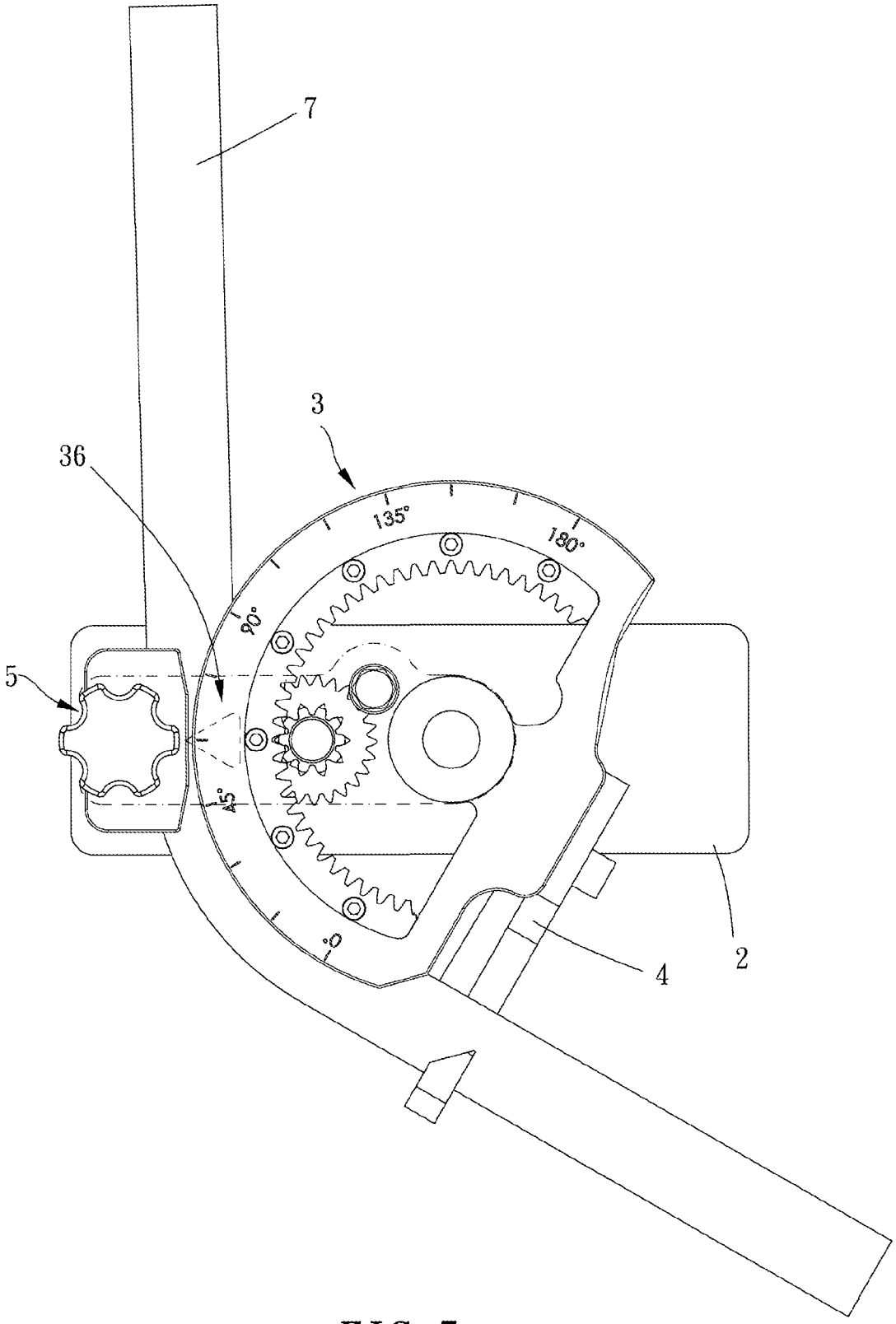
Figure 6:
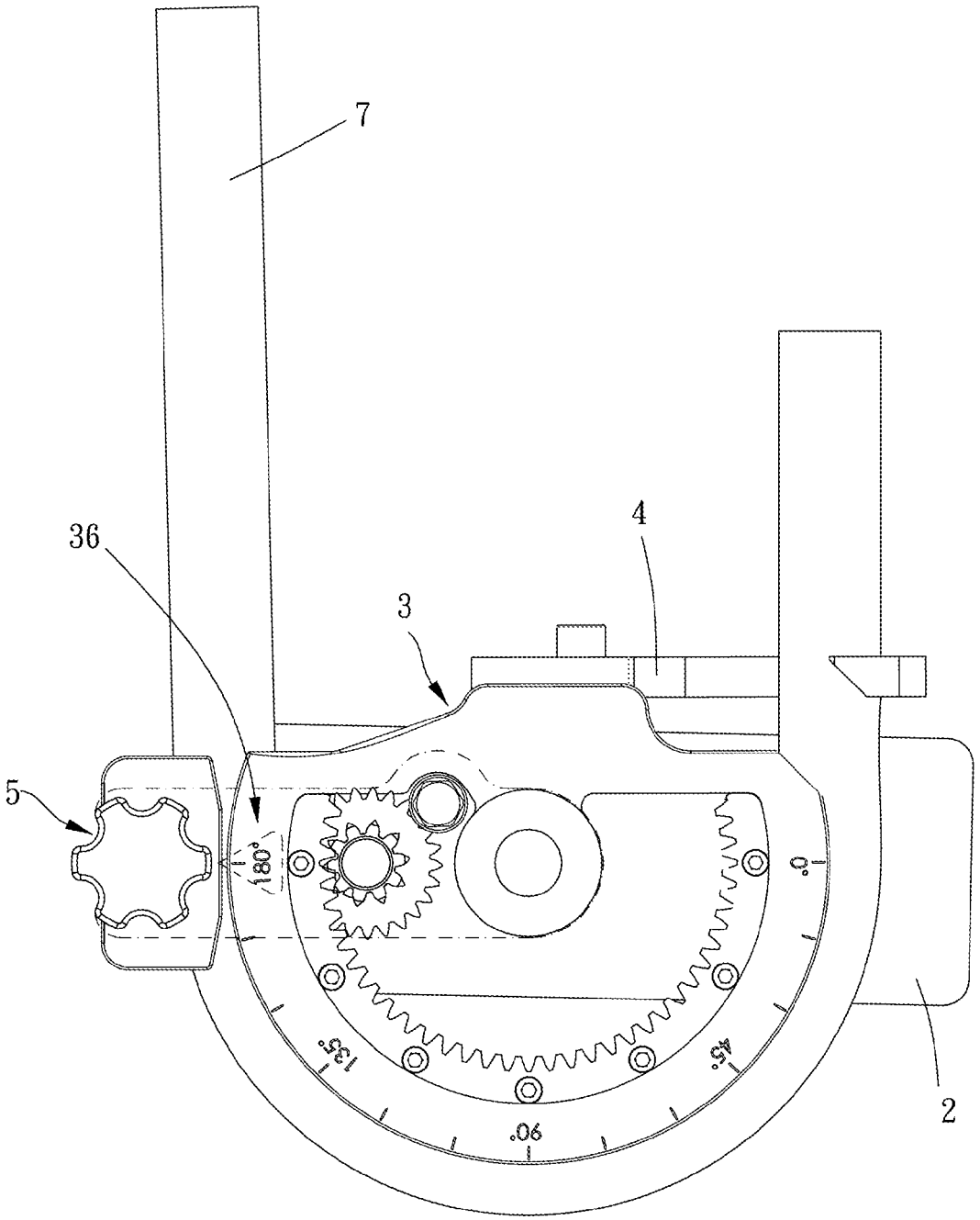

Please further refer to FIGS. 4 to 6. The rotatable member 3 further has an angle reference portion 35, and the abutting assembly 5 further has an indication portion 36 corresponding to the angle reference portion 35; therefore, the bending angle of the tube member 7 is shown clearly. More specifically, in this embodiment, the angle reference portion 35 ranges from 0 to 180 degrees, and the indication portion 36 is a through hole. A reference angle value of the angle reference portion 35 is observed via the through hole to show the bending angle. The indication portion 36 may be in other forms as long as the user is able to know the bending angle easily.

Given the above, in the tube bender of the present invention, the driving assembly which has smaller diametral pitch drives the rotating assembly which has greater diametral pitch; therefore it is more energy-saving for the user to drive the rotatable member of the tube bender and to bend the tube member through the cooperation of the holding portion and the abutting assembly.

In addition, the tube bender is convenient for the user to carry around and use, and the user may replace members in different dimensions in accordance with various requirements. When a member is damaged, the user only needs to replace the damaged member.

While we have shown and described various embodiments in accordance with the present invention, it should be clear to those skilled in the art that further embodiments may be made without departing from the scope of the present invention.

What is claimed is:

1. A tube bender, including:

a base, having a pivot portion;

a rotatable member, pivoted to the pivot portion, defining an inner space, having a rack portion, a first arched groove and a holding portion, the rack portion archedly extending around the pivot portion and located within the inner space, the first arched groove archedly extending around the pivot portion on an outer circumferential surface of the rotatable member, the holding portion having a holding recess for a tube member to abut thereagainst;

an abutting assembly, having an arm portion connected with the base and an abutting chunk assembled to the arm portion; and a gear assembly, including a driving assembly for being driven by a driving tool and a rotating assembly which is pivoted to the base and rotatably connected with the driving assembly, the driving assembly being pivoted to the arm portion and non-coaxially arranged with the rotating assembly, the rotating assembly having a first toothed portion meshed with the rack portion and a driven portion meshed with the driving assembly;

wherein the first toothed portion is arranged on an outer circumferential surface of a first gear, and the driven portion is a second gear having a second toothed portion.

2. The tube bender of claim 1, wherein the first gear and the second gear are coaxially arranged and comovably connected with each other.

3. The tube bender of claim 2, wherein the first gear and the second gear are disposed through by a first pivot axle and pivoted to the base.

4. The tube bender of claim 3, wherein one of the second gear and the first pivot axle has a recess portion, and the other of the second gear and the first pivot axle has a protrusive portion which is engageable with the recess portion.

5. The tube bender of claim 1, wherein the rotatable member further includes a main body, the main body defines the inner space, and the rack portion is detachably assembled with the main body.

6. The tube bender of claim 5, wherein the holding portion is detachably connected with the main body.

7. The tube bender of claim 1, wherein the rotatable member further has an angle reference portion, and the abutting assembly further has an indication portion which corresponds to the angle reference portion.

8. The tube bender of claim 1, wherein as viewed in a radial direction of the rotatable member, a radial edge of the holding recess is located outwardly beyond a radial edge of the first arched groove.

9. The tube bender of claim 1, wherein as viewed in a radial direction of the rotatable member, the holding recess and the first arched groove form a holding aperture.

10. The tube bender of claim 1, wherein the abutting chunk is detachably assembled to the arm portion through a pin.

11. The tube bender of claim 1, wherein the abutting chunk is detachably positioned between the arm portion and the base.

12. The tube bender of claim 1, wherein the abutting chunk has a second arched groove opposite to the first arched groove, and the second arched groove and the first arched groove arch oppositely.

13. A tube bender, including:

a base, having a pivot portion;

a rotatable member, pivoted to the pivot portion, defining an inner space, having a rack portion, a first arched groove and a holding portion, the rack portion archedly extending around the pivot portion and located within the inner space, the first arched groove archedly extending around the pivot portion on an outer circumferential surface of the rotatable member, the holding portion having a holding recess for a tube member to abut thereagainst;

an abutting assembly, having an arm portion connected with the base and an abutting chunk assembled to the arm portion; and a gear assembly, including a driving assembly for being driven by a driving tool and a rotating assembly which is pivoted to the base and rotatably connected with the driving assembly, the driving assembly being pivoted to the arm portion and non-coaxially arranged with the rotating assembly, the rotating assembly having a first toothed portion meshed with the rack portion and a driven portion meshed with the driving assembly;

wherein an outer circumferential surface of the driving assembly is formed with a fourth toothed portion meshed with the driven portion, the driven portion is a second gear having a second toothed portion, and a diametral pitch of the second gear is greater than a diametral pitch of the fourth toothed portion of the driving assembly.

14. A tube bender, including:

a base, having a pivot portion;

a rotatable member, pivoted to the pivot portion, defining an inner space, having a rack portion, a first arched groove and a holding portion, the rack portion archedly extending around the pivot portion and located within the inner space, the first arched groove archedly extending around the pivot portion on an outer circumferential surface of the rotatable member, the holding portion having a holding recess for a tube member to abut thereagainst;

an abutting assembly, having an arm portion connected with the base and an abutting chunk assembled to the arm portion; and a gear assembly, including a driving assembly for being driven by a driving tool and a rotating assembly which is pivoted to the base and rotatably connected with the driving assembly, the driving assembly being pivoted to the arm portion and non-coaxially arranged with the rotating assembly, the rotating assembly having a first toothed portion meshed with the rack portion and a driven portion meshed with the driving assembly;

wherein the arm portion is connected with the base through a second pivot axle which is disposed through the rotatable member and pivoted to the pivot portion.

* * * * *